US008247151B2

(12) United States Patent
Victor et al.

(10) Patent No.: US 8,247,151 B2
(45) Date of Patent: Aug. 21, 2012

(54) LIQUID TONER, ELECTROPHORETIC INK, AND METHODS OF MAKING AND USE

(75) Inventors: Gal Victor, Rehovot (IL); Galia Golodetz, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 243 days.

(21) Appl. No.: 12/581,677

(22) Filed: Oct. 19, 2009

(65) Prior Publication Data

US 2011/0091798 A1 Apr. 21, 2011

(51) Int. Cl.
*G03G 9/13* (2006.01)

(52) U.S. Cl. ..... 430/114; 430/112; 430/115

(58) Field of Classification Search ..... 430/32, 430/112, 114, 115
See application file for complete search history.

(56) References Cited

U.S. PATENT DOCUMENTS

| | | | | |
|---|---|---|---|---|
| 4,925,766 | A | 5/1990 | Elmasry et al. | |
| 5,098,475 | A | 3/1992 | Winnik et al. | |
| 5,120,361 | A | 6/1992 | Winnik et al. | |
| 5,256,516 | A | 10/1993 | Winnik et al. | |
| 5,332,640 | A | 7/1994 | Duff et al. | |
| 5,407,771 | A | 4/1995 | Landa et al. | |
| 5,558,968 | A | 9/1996 | Russell et al. | |
| 5,622,804 | A * | 4/1997 | Matsuoka et al. | 430/115 |
| 5,723,250 | A | 3/1998 | Matsuoka et al. | |
| 5,723,511 | A | 3/1998 | Kazmaier et al. | |
| 6,096,801 | A | 8/2000 | Vincent et al. | |
| 6,114,499 | A | 9/2000 | Kazmaier et al. | |
| 6,258,896 | B1 | 7/2001 | Abuelyaman et al. | |
| 6,699,597 | B2 | 3/2004 | Bellmann et al. | |
| 2004/0072923 | A1 | 4/2004 | Matsunami et al. | |
| 2004/0137263 | A1 | 7/2004 | Burn et al. | |
| 2005/0147843 | A1 | 7/2005 | Kobayashi et al. | |
| 2005/0171237 | A1 | 8/2005 | Patel et al. | |
| 2005/0277708 | A1 | 12/2005 | Vanmaela et al. | |
| 2006/0009614 | A1 | 1/2006 | Yamahara et al. | |
| 2006/0102890 | A1 | 5/2006 | Yamahara et al. | |
| 2007/0154832 | A1 | 7/2007 | Hong et al. | |
| 2007/0194704 | A1 | 8/2007 | Koyama | |
| 2007/0197684 | A1 | 8/2007 | Yamashita et al. | |
| 2007/0290604 | A1 | 12/2007 | Sakanoue et al. | |
| 2009/0015139 | A1 | 1/2009 | Uetani et al. | |

FOREIGN PATENT DOCUMENTS

WO 2006/115547 A2 11/2006

OTHER PUBLICATIONS

Wikipedia "Dendrimer" printed Oct. 14, 2009, 5 pages, http://en.wikipedia.org/wiki/Dendrimer.

Product Information "Dendrons in Nanomaterials" 2009, Sigma-Aldrich Co., 4 pages, printed Oct. 14, 2009, http://www.sigmaaldrich.com/materials-science/nanomateriasi/dendrimers/dendrons.

* cited by examiner

*Primary Examiner* — Peter Vajda

(57) ABSTRACT

LEP ink includes a carrier and particles dispersed in the carrier. Particles contain polymeric resin and dendritic macromolecule having functional groups. Some dendritic macromolecule functional groups are coupled to some resin functional groups. Other dendritic macromolecule functional groups are not coupled to any component of the resin. Other resin functional groups are not coupled to any component of the dendritic macromolecule. Liquid toner producing methods include forming a paste containing a carrier liquid and a thermoplastic resin having a polymeric backbone and functional groups. The paste is combined with a colorant and an adhesion promoting dendritic macromolecule having functional groups. After combining the paste and dendritic macromolecule, the method includes coupling the dendritic macromolecule functional groups with resin functional groups, encapsulating the colorant in the resin/dendritic macromolecule, and dispersing the encapsulated colorant in the carrier liquid. The dendritic macromolecule increases durability in printed images using the ink or toner.

15 Claims, No Drawings

LIQUID TONER, ELECTROPHORETIC INK, AND METHODS OF MAKING AND USE

BACKGROUND

One of the significant properties of known ink, such as liquid electrophoretic (LEP) ink, includes its ability to adhere to a substrate when used to form a hard image. One known method for evaluating the adherence property includes applying tape on a printed ink layer and measuring the amount of area from which ink was removed from the substrate or the amount of area on which ink remained on the substrate after removing the tape. New media for substrates, increased printing speeds, and re-formulated inks are under continuous development to meet market demands for greater quality, efficiency, and variability in printing. Consequently, the ability to consistently provide suitable ink adherence may be beneficial.

DETAILED DESCRIPTION OF THE EMBODIMENTS

Generally, LEP ink and some other inks include a plurality of particles dispersed in a non-polar carrier liquid. Individual particles of the plurality contain a polymeric resin encapsulating a colorant, such as dye or a coloring particle. LEP ink further includes additives configured to charge the particles.

Although the discussion herein is mostly directed to LEP ink, the embodiments may be more broadly applicable. For that reason, references are made to a "marking agent," a generic term encompassing LEP ink, toner, and other substances. Similarly, although the discussion herein is directed to pigments, the embodiments may be more broadly applicable. For that reason, references are made to a "coloring particle," a generic term encompassing pigments and other substances. Further, although the discussion herein is directed to LEP presses, the embodiments may be more broadly applicable. For that reason, references are made to "forming a hard image," a generic term encompassing printing with a LEP press and other methods. Thus, the embodiments may involve using a marking agent containing a coloring particle to form a hard image, which encompasses using LEP ink or toner containing a pigment in a LEP press and other methods.

The ability of an ink to adhere to a substrate is believed to depend, to great extent, on interaction of the resin with a substrate. The commonly known "peel test," such as that described in the Examples below and the like, represents one method of quantifying ink durability, among other methods. Selection of a resin with a particular type of functional group may increase durability by forming chemical bonds with a particular substrate. Similarly, increasing the prevalence of such functional groups may additionally increase durability. However, ink adherence represents one factor in selecting a resin among numerous known factors related to other ink properties, such as dispersion, charging, optical density and color properties of a hard image, gloss, particle size distribution, viscosity, mechanical properties, etc.

For some inks, few options may exist for selecting a resin because of other standards for ink properties, allowing few choices for selecting an ink with suitable adherence. In LEP ink, a subtle balance exists between the number of resin functional groups, which interact with additives to create suitability for LEP printing processes, and non-polar functional groups that provide compatibility with non-polar carrier liquids. For example, resin non-polar groups allow non-polar carriers to solvate the resin.

In the described embodiments, a functional group of a selected type and number may be introduced by way of a functionalized dendritic macromolecule, such as a dendrimer, into a resin system with the objective of adding chemical functionality that increases adherence with little or no degradation of other ink properties. Chargeability and/or dispersion represent the ink properties most likely to be affected. With the designed addition of desired functionalities using low concentrations of a dendritic macromolecule, measurable reduction in peeling may be realized by increasing interaction of the resin with the substrate. The addition may be designed so as to reduce any upset in the subtle balance between the number of resin functional groups and interaction with ink additives. Since functional groups of a dendritic macromolecule may couple with functional groups of a resin, a high potential exists for upsetting the subtle balance mentioned.

As known to those of ordinary skill, dendritic macromolecules may include dendrimers, dendrons, and hyperbranched polymers. Known dendrimer chemistry involves highly branched monomers in a tree-like or generational structure with extremely low polydispersity, perhaps monodispersity. A dendrimer may contain a multifunctional core molecule with a dendritic "wedge" attached to each functional site. The core molecule is referred to as "generation 0." Each successive repeat unit along all branches forms the next generation, "generation 1," "generation 2," and so on until the terminating generation. Dendrimers are of interest for their unusual physical properties and an ability to precisely control their surface.

One interesting physical property of dendrimers is the variation of their intrinsic viscosities with molecular weight. When the number of generations increases beyond a certain point, observation indicates that intrinsic viscosity begins to decline, contrary to the behavior of linear polymers. This effect is believed to be a consequence of the spheroid or globular shapes of high generation dendrimers, leaving them unable to "tangle" with one another.

The chemical properties of dendrimers are dominated by functional groups on the molecular surface. As mentioned, dendrimers are spheroid or globular nanostructures. Size, shape, and reactivity are determined by the generational "shells," chemical composition of the core, interior branching, and surface functionalities. While dendrimer diameter increases linearly, the number of surface groups increases geometrically. Dendrimers are very uniform and are commonly created with dimensions incrementally grown in approximately nanometer (nm) steps from 1 to over 10 nm. This highly defined and organized structure allows having sort of anchoring units with a defined nature and a defined number of functional groups on the periphery. In this way, dendrimers may be incorporated into an ink that exhibits an affinity to the resin system as well as a chemical functionality to increase adherence of the ink to a substrate by chemical bonding.

A dendron is essentially a wedge-shaped section of a dendrimer. It is monodisperse, like a dendrimer. Unlike a dendrimer, the "generation 0" core molecule may participate in reactions. A hyperbranched polymer exhibits dendrimer-like properties, but is polydisperse and imperfectly branched. It may be created in a single polymerization step. Understandably, it is conceivable that dendrons and hyperbranched polymers may function in an ink in much the same way as the dendrimer described above. Nevertheless, a dendrimer might be most effective in some circumstances given its unique properties.

In an embodiment a liquid electrophoretic ink includes a non-polar carrier liquid, a plurality of particles dispersed in the carrier liquid, and additives configured to charge the particles. Individual particles of the plurality contain a polymeric resin having functional groups, at least some of which are non-polar, and a dendritic macromolecule having polar functional groups. Some of the dendritic macromolecule polar groups are coupled to some of the resin non-polar groups. Other of the dendritic macromolecule polar groups are not coupled to any component of the resin. Other of the resin non-polar groups are not coupled to any component of the dendritic macromolecule.

By way of example, the dendritic macromolecule polar groups not coupled to any component of the resin may be available to chemically bond to a substrate on which the ink is printed. Also, the resin non-polar groups not coupled to any component of the dendritic macromolecule may be available to participate in interactions that provide desired chemical properties of the ink when the dendritic macromolecule is not present. The chemical properties may continue to be provided even with the dendritic macromolecule present. From about 4 to about 25 wt %, or 10 to 15 wt %, of the resin may be attributed to polar groups.

Selection of the amount of dendritic macromolecule and its functional groups may be designed in consideration with the resin functional groups to exhibit little, if any, impact on chemical properties of the ink when the dendritic macromolecule is present. By coupling the dendritic macromolecule with resin, the dendritic macromolecule may survive various transfer stages that may occur in a hard imaging device, such as a LEP press. The dendritic macromolecule then arrives as part of an ink particle at the substrate. As a result, dendritic macromolecule bridging may occur between the substrate and the resin functional groups, increasing durability compared to a same image printed in a same manner instead using an ink lacking the dendritic macromolecule, but otherwise identical. In this manner, even though dendritic macromolecule bridging may be provided, ink performance may be maintained.

Also, selection of the amount of dendritic macromolecule and its functional groups may be designed in consideration with the resin functional groups intentionally to alter chemical properties of the ink. Potentially, different dendritic macromolecules may exhibit different mechanical, optical, chargeability, etc. properties. Optimization of a formulation may involve selecting among various dendritic macromolecules to yield a desired effect in addition to decreasing peeling. Further, multifunctional dendritic macromolecules are conceivable where one functional group provides one effect, such as coupling to a resin, while another functional group provides another effect. Selection of dendritic macromolecules may thus allow tuning or optimizing performance.

Also by way of example, the resin may include both polar and non-polar groups. The presence of non-polar groups provides compatibility with the non-polar carrier liquid and may also provide additional ink properties of itself or by way of interaction with ink additives. The presence of polar groups may similarly provide additional ink properties of itself or by way of interaction with ink additives.

The dendritic macromolecule having polar groups might not additionally comprise any non-polar groups. In such case, compatibility of the dendritic macromolecule with non-polar carrier liquid depends on coupling to the resin. However, the dendritic macromolecule having polar groups could further include non-polar groups to provide compatibility with non-polar carrier liquid and/or to provide other properties. Although the present embodiment includes a dendritic macromolecule having polar groups or having polar and non-polar groups, other embodiments described herein may include a dendritic macromolecule having only non-polar groups.

The resin may have a polymeric backbone and the dendritic macromolecule might not comprise any part of the backbone. Consequently, embodiments herein may be distinguished from known inks that use dendrimers in formation of a polymeric resin backbone. For example, U.S. Pat. No. 6,114,499 issued to Kazmaier describes a process for the preparation of branched thermoplastic resins exhibiting a narrow polydispersity. Kazmaier describes specialized polymerization processes that tailor the physical properties of resulting polymers, such as dendrimers, in a desired manner. However, the dendrimers themselves form the backbone of the polymeric resin.

Embodiments described herein differ from Kazmaier in that a dendritic macromolecule included in an ink might not comprise any part of the resin backbone and instead may be classified as an ink additive. Additionally, since the dendritic macromolecule is used as an ink additive, taking advantage of its polyfunctionality to create bridging between the resin and the substrate, various types of dendritic macromolecules, such as hyperbranched polymers or dendrons can be used. Embodiments herein exhibit less need for a dendrimer having a perfect structure, contrary to Kazmaier in which the dendrimer structure provides the desired, specific fusing temperature. Such dendritic macromolecule additives may alter ink properties, but may be used without fundamental change in ink composition. A weight percent of the dendritic macromolecule in the ink on a non-volatile solids basis (wt % NVS) may be from about 1 to about 10%, or from 2 to 5%.

Dendritic macromolecule composition in an ink may be described on a number of different bases to account for various considerations in selecting composition. The ink may exhibit a value of about 0.01 to about 0.25, about 0.02 to about 0.1, or 0.04 to 0.06 for a ratio of a wt % NVS of the dendritic macromolecule in the ink to a wt % NVS of the resin in the ink, which ratio is referred to herein as the dendritic macromolecule/resin ratio. The dendritic macromolecule/resin ratio accounts for the total mass of dendritic macromolecule in relation to the total mass of resin without regard to dendritic macromolecule and resin functionality. As the mass of resin in an ink increases, the mass of dendritic macromolecule may similarly increase to maintain the dendritic macromolecule/resin ratio. Notably, the relative mass of dendritic macromolecule in the ink may be quite small.

The ink may exhibit a value of about 0.2 to about 1.0, about 0.2 to about 0.6, or 0.3 to 0.4, for a ratio of a wt % NVS of the dendritic macromolecule to a wt % NVS of all functional groups of the resin, which ratio is referred to herein as the dendritic macromolecule/resin function ratio. The dendritic macromolecule/resin function ratio accounts for the total mass of dendritic macromolecule in relation to the total mass of functional groups of the resin without regard to the total mass of all the resin. Consequently, a given mass of dendritic macromolecule may fall within the described range both for a given mass of a highly functionalized resin as well as for a greater mass of a less functionalized resin. Notably, the relative mass of dendritic macromolecule in the ink may be quite small in comparison to the mass of resin functional groups. The range for the dendritic macromolecule/resin function ratio is consistent with the described advantage of the mass of dendritic macromolecule exhibiting little, if any impact on chemical properties of the ink.

The ink may exhibit a value of about 0.001 to about 0.9, about 0.005 to about 0.02, or 0.01 to 0.014, for a ratio of a wt % NVS of all functional groups of the dendritic macromolecule to a wt % NVS of all functional groups of the resin, which ratio is referred to herein as the dendritic macromolecule function/resin function ratio. The dendritic macromolecule function/resin function ratio accounts for the total mass of functional groups of the dendritic macromolecule in relation to the total mass of functional groups of the resin without regard to the total mass of the dendritic macromolecule and the total mass of the resin. As the mass of resin functional groups increases, the mass of dendritic macromolecule functional groups may similarly increase to maintain the dendritic macromolecule function/resin function ratio. Notably, the mass of dendritic macromolecule functional groups may be quite small in comparison to the mass of resin functional groups.

Dendritic macromolecule content less than the amounts described may result in too insignificant of an effect relative to decreasing peeling. Dendritic macromolecule content greater than the amounts described may result in degradation of ink properties. Understandably, the described functional group masses and/or ratios may be calculated in a known manner, rather than measured, based on known polymer properties of a particular dendritic macromolecule or resin. Depending on the functional groups of the resin, it is possible that a functional group randomly selected for the dendritic macromolecule may or may not effectively couple with the resin functional groups. Consequently, designed selection of the amounts and functionality of a dendritic macromolecule may significantly contribute to achieving desirable properties.

With focus of the embodiments on functional groups, a great degree of variability is possible for the underlying structure of the dendritic macromolecule. Tuning the dendritic macromolecule to a particular ink/resin may allow identifying functionalities and a compositional range that provides real benefits with few, if any, side effects. A variety of bond types are possible to couple the dendritic macromolecule to the resin, such as acid-base bonding, van der Waals bonding, hydrogen bonding, dipole-dipole interaction, etc.

Possible functional groups for a polymeric resin in LEP ink and other inks are wide-ranging and widely known. For the dendritic macromolecule additive described herein, possible polar functional groups include hydroxyl, carboxyl, amide, aromatic amine, amine, imine, azide, aziridine, carbonyl, aldehyde, anhydride, ketone, peroxide, epoxy, ester, acryl, and combinations thereof. Possible non-polar functional groups include allyl, alkanes, alkenes, and combinations thereof. Additional functional groups are conceivable that may exhibit properties providing the advantages described herein.

It is conceivable that the durability increase observed in the Examples resulted from increased adhesion of resin to the substrate as well as increased cohesion of the resin. That is, the dendritic macromolecule could potentially cross-link within the resin in addition to bridging to the substrate. No difference might be observed in ink viscosity or other properties if cross-linking occurs, but melt viscosity of a printed image could change, increasing with the existence of cross-linking. However, the existence of cross-linking was not measured and is uncertain.

In an embodiment, a liquid toner producing method includes forming a paste containing a non-polar, hydrocarbon carrier liquid and a thermoplastic resin having a polymeric backbone and functional groups, at least some of which are non-polar. The paste is combined with a colorant, additional carrier liquid, and an adhesion promoting dendritic macromolecule having functional groups. After combining the paste and dendritic macromolecule, the method includes coupling the dendritic macromolecule functional groups with resin functional groups, encapsulating the colorant in the resin/dendritic macromolecule, and dispersing the encapsulated colorant in the combined carrier liquid and additional carrier liquid.

By way of example, the dendritic macromolecule might not comprise any part of the backbone. As one example, the colorant and dendritic macromolecule may be combined with the paste at the same time. Such may be the case when the paste, colorant, additional carrier liquid, and dendritic macromolecule are separately added to a grinding apparatus together and ground at the same time. As another example, in the circumstance where the dendritic macromolecule does not comprise any part of the backbone, the colorant may be combined with the paste after the dendritic macromolecule is combined with the paste.

The coupling, encapsulating, and dispersing may occur while grinding the paste, colorant, additional carrier liquid, and dendritic macromolecule together. The combining may include additives configured to charge the encapsulated colorant. An image printed using the liquid toner may exhibit increased durability compared to a same image printed in a same manner instead using a liquid toner produced by a method lacking use of the dendritic macromolecule, but otherwise identical.

As may be appreciated from the discussion herein, one advantage of the embodiments includes easily incorporating dendritic macromolecules into standard methods for producing ink, especially LEP ink, with little or no modification of the methods. Although dendritic macromolecule may be added either before or after the colorant and other components, a level of convenience exists in adding them together for more efficient processing. It may be considered an advantage of the embodiments that adhesion promoting dendritic macromolecule can be added at the same time as other ink components without specialized processing.

In an embodiment, a digital printing method includes providing a liquid marking agent containing a plurality of charged particles dispersed in a carrier liquid and, by electrophotographic means, printing a hard image on a substrate using the marking agent. Individual particles of the plurality contain a polymeric resin having functional groups and a dendritic macromolecule having functional groups. Some of the dendritic macromolecule functional groups are coupled to some of the resin functional groups and other of the dendritic macromolecule functional groups are not coupled to any component of the resin. The liquid marking agent contains 1 to 10 wt % NVS of the dendritic macromolecule. At least a portion of the dendritic macromolecule's functional groups not coupled to the resin chemically bond to the substrate. The substrate-bonded dendritic macromolecule bridges between the substrate and resin functional groups.

By way of example, the carrier liquid may be non-polar. The resin may include non-polar functional groups. The dendritic macromolecule may include polar functional groups. The resin may have a polymeric backbone wherein the dendritic macromolecule does not comprise any part of the backbone. The printed image may exhibit increased durability compared to a same image printed in a same manner instead using a marking agent lacking the dendritic macromolecule, but otherwise identical.

These and other benefits may be further appreciated from the Examples below illustrating various embodiments.

EXAMPLE 1

An ink was prepared using the same components, composition, and methods as a violet reference ink. Paste was prepared using resin containing 65 wt % NUCREL 960 (copolymer of ethylene and methacrylic acid available from E.I. du Pont de Nemours in Wilmington, Del., containing 15 wt % methacrylic acid), 15 wt % NUCREL 699 (copolymer of ethylene and methacrylic acid available from du Pont, containing 11 wt % methacrylic acid), and 20 wt % A-C 5180 (ethylene-acrylic acid copolymer available from Honeywell in Morristown, N.J., containing acrylic acid exhibiting an Acid Number 200 mg KOH/g) along with ISOPAR L carrier (isoparaffinic solvent available from ExxonMobil Chemical in Houston, Tex.) by mixing the components and heating the mixture to 140° C. and then letting the mixture cool down to room temperature. The paste, Lumiere Violet RPM (violet pigment), aluminum tri-stearate, additional carrier, and a hydroxyl-functional dendritic polyester were added to a 1-S ATTRITOR (batch grinding mill available from Union Process Co. in Akron, Ohio). Grinding was performed according to the same grinding profile (time and temperature) as the violet reference ink lacking the dendrimer. The dendrimer had 6 hydroxyl, polar functional groups total for the whole dendrimer molecule, a hydroxyl number of 105-125 mg KOH/g, a weight average molecular weight ($M_w$) of 3200 g/mole, and a viscosity at 23° C. of 14 to 20 Pa-s. The resulting violet ink contained 5 wt % dendrimer. The dendrimer/resin ratio was 0.07, the dendrimer/resin function ratio was 0.41, and the dendrimer function/resin function ratio was 0.014.

EXAMPLE 2

An ink was prepared using the same components, composition, and methods as a white reference ink. Paste was prepared using resin containing 75 wt % NUCREL 960, 20 wt % NUCREL 699, and 5% SURLYN 8120 (ethylene/methacrylic acid (E/MAA) copolymer available from du Pont in which methacrylic acid groups are partially neutralized with sodium ions) along with ISOPAR L carrier by mixing the components and heating the mixture to 140° C. and then letting the mixture cool down to room temperature. The paste, KEMIRA 405 (alumina surface treated, hydrophobic titanium dioxide white pigment available from Kemira in Helsinki, Finland), aluminum tri-stearate, additional carrier, and the hydroxyl-functional dendritic polyester of Example 1 were added to a 1-S ATTRITOR. Grinding was performed according to the same grinding profile (time and temperature) as the white reference ink lacking the dendrimer. The resulting white ink contained 2 wt % dendrimer. The dendrimer/resin ratio was 0.04, the dendrimer/resin function ratio was 0.31, and the dendrimer function/resin function ratio was 0.011.

EXAMPLE 3

The violet reference ink and the ink of Example 1 were printed on UPM Finesse gloss, 130 gram/meter$^2$ basis weight, (high-white, wood free coated paper available from UPM in Helsinki, Finland) using a HP INDIGO 7000 Digital Press available from HP-Indigo in Rehovot, Israel. Peeling was tested by applying SCOTCH 230 drafting tape (available from 3M Co. in St. Paul, Minn.) over the print, 10 minutes after printing. Tape was forced to the print by 10 strokes of a roller of 1 kg and then was removed. Peeling for the dendrimer-containing ink decreased by 20% (from 60% to 72% undamaged area).

EXAMPLE 4

The white reference ink and the ink of Example 2 were printed on clear biaxially oriented polypropylene (BOPP) film using a WS6000 Digital Press available from HP-Indigo. Peeling was tested as described in Example 3. Peeling for the dendrimer-containing ink decreased by 25% (from 79% to 99% undamaged area).

The invention claimed is:

1. A liquid electrophoretic ink comprising:

a non-polar carrier liquid;

a plurality of particles dispersed in the carrier liquid, individual particles of the plurality containing:

a polymeric resin having functional groups, at least some of which are non-polar;

a dendritic macromolecule having polar functional groups, some of the dendritic macromolecule polar groups being coupled to some of the resin non-polar groups, other of the dendritic macromolecule polar groups not being coupled to any component of the resin to facilitate particle adhesion to a substrate, and other of the resin non-polar groups not being coupled to any component of the dendritic macromolecule; and a colorant encapsulated by the coupled polymeric resin and dendritic macromolecule to form the particles; and additives configured to charge the particles.

2. The ink of claim 1 wherein the resin comprises both polar and non-polar groups.

3. The ink of claim 1 wherein the resin has a polymeric backbone and the dendritic macromolecule does not comprise any part of the backbone.

4. The ink of claim 1 wherein the ink exhibits a value of 0.01 to 0.25 for a ratio of a wt % NVS of the dendritic macromolecule to a wt % NVS of the resin.

5. The ink of claim 1 wherein the ink exhibits a value of 0.02 to 1.0 for a ratio of a wt % NVS of the dendritic macromolecule to a wt % NVS of all functional groups of the resin.

6. A digital printing method comprising:

providing a liquid marking agent containing a plurality of charged particles dispersed in a carrier liquid, individual charged particles of the plurality containing:

a polymeric resin having functional groups;

a dendritic macromolecule having functional groups, some of the dendritic macromolecule functional groups being coupled to some of the resin functional groups, other of the dendritic macromolecule functional groups not being coupled to any component of the resin, and the liquid marking agent containing 1 to 10 wt % NVS of the dendritic macromolecule;

a colorant encapsulated by the coupled polymeric resin and dendritic macromolecule to form the particles; and additives configured to charge the particles; and by electrophotographic means, printing a hard image on a substrate using the marking agent, at least a portion of the functional groups of the dendritic macromolecule not coupled to the resin chemically bonding to the substrate and the substrate-bonded dendritic macromolecule bridging between the substrate and the resin functional groups.

7. The method of claim 6 wherein the carrier liquid is non-polar, the resin comprises non-polar functional groups, and the dendritic macromolecule comprises polar functional groups.

8. The method of claim 6 wherein the resin has a polymeric backbone and the dendritic macromolecule does not comprise any part of the backbone.

9. The method of claim 6 wherein the marking agent exhibits a value of 0.001 to 0.9 for a ratio of a wt % NVS of all functional groups of the dendritic macromolecule to a wt % NVS of all functional groups of the resin.

10. The method of claim 6 wherein the printed image exhibits increased durability compared to a same image printed in a same manner instead using a marking agent lacking the dendritic macromolecule, but otherwise identical.

11. A liquid toner producing method comprising:

forming a paste containing a non-polar, hydrocarbon carrier liquid and a thermoplastic resin having a polymeric backbone and functional groups, at least some of which are non-polar;

combining the paste with a colorant, additional carrier liquid, an adhesion promoting dendritic macromolecule having functional groups, and a charge additive; and after combining the paste and the dendritic macromolecule, coupling some of the dendritic macromolecule functional groups with some of the resin functional groups, encapsulating the colorant in the resin/dendritic macromolecule, other of the functional groups of the dendritic macromolecule not coupled with the resin functional groups being configured to facilitate adhesion of the encapsulated colorant to a substrate, and dispersing the encapsulated colorant in the combined carrier liquid and additional carrier liquid.

12. The method of claim 11 wherein the dendritic macromolecule does not comprise any part of the backbone.

13. The method of claim 11 wherein the colorant, the charge additive, and the dendritic macromolecule are combined with the paste at the same time.

14. The method of claim 11 wherein the coupling, the encapsulating, and the dispersing occur while grinding the paste, the colorant, the charge additive, the additional carrier liquid, and the dendritic macromolecule together.

15. The method of claim 11 wherein an image printed using the liquid toner exhibits increased durability compared to a same image printed in a same manner instead using a liquid toner produced by a method lacking use of the dendritic macromolecule, but otherwise identical.

* * * * *